US005487424A

United States Patent [19]

Davison

[11] Patent Number: 5,487,424

[45] Date of Patent: Jan. 30, 1996

[54] DOUBLE-WALL WELDED PLATE HEAT EXCHANGER

[75] Inventor: Roger C. Davison, Wichita Falls, Tex.

[73] Assignee: Tranter, Inc., Augusta, Ga.

[21] Appl. No.: 286,536

[22] Filed: Aug. 5, 1994

Related U.S. Application Data

[63] Continuation-in-part of Ser. No. 76,110, Jun. 14, 1993.

[51] Int. Cl.[6] ..... F28F 3/08

[52] U.S. Cl. ..... 165/166; 165/70

[58] Field of Search ..... 165/165, 166, 165/70

[56] References Cited

U.S. PATENT DOCUMENTS

| | | | |
|---|---|---|---|
| 1,826,344 | 10/1931 | Dalgliesh | 165/166 X |
| 2,361,691 | 10/1944 | Jendrassik | 165/166 |
| 2,623,736 | 12/1952 | Hytte | 165/166 X |
| 3,148,442 | 9/1964 | Gier, Jr. | 29/890.054 |
| 3,198,248 | 8/1965 | Stack | 165/166 |
| 3,463,222 | 8/1969 | Grames | 165/10 |
| 3,517,733 | 6/1970 | Tasker et al. | 165/166 |
| 4,043,388 | 8/1977 | Zebuhr | 165/166 |
| 4,246,961 | 1/1981 | Chaix et al. | 165/165 X |
| 4,249,597 | 2/1981 | Carey | 165/166 |
| 4,343,355 | 8/1982 | Goloff et al. | 165/166 |
| 4,351,391 | 9/1982 | Eberhardt | 165/154 |
| 4,556,105 | 12/1985 | Boner | 165/165 |
| 4,569,391 | 2/1986 | Hulswitt et al. | 165/166 |
| 4,609,039 | 9/1986 | Fushiki et al. | 165/166 X |
| 4,688,631 | 8/1987 | Peze et al. | 165/166 |
| 4,696,342 | 9/1987 | Yamauchi et al. | 165/152 |
| 4,815,534 | 3/1989 | Fuerschbach | 165/167 |
| 4,858,685 | 8/1989 | Szucs et al. | 165/166 |
| 4,976,313 | 12/1990 | Dahlgren et al. | 165/167 |
| 5,025,856 | 6/1991 | Van Dyke et al. | 165/167 |
| 5,069,276 | 12/1991 | Seidel | 165/166 |
| 5,178,207 | 1/1993 | Bergqvist et al. | 165/70 |
| 5,291,945 | 3/1994 | Blomgren et al. | 165/167 |
| 5,301,747 | 4/1994 | Daschmann et al. | 165/166 |

FOREIGN PATENT DOCUMENTS

| | | | |
|---|---|---|---|
| 1183834 | 3/1985 | Canada . | |
| 4100940C1 | 11/1991 | Germany . | |
| 65888 | 5/1980 | Japan | 165/166 |
| 867214 | 5/1961 | United Kingdom | 165/166 |

*Primary Examiner*—Leonard R. Leo

*Attorney, Agent, or Firm*—Barnes, Kisselle, Raisch, Choate, Whittemore & Hulbert

[57] ABSTRACT

A plate heat exchanger having a first set of plate assemblies arranged alternately with a second set of plate assemblies in a stack. Each plate assembly has first and second plates which are spaced apart to define a flow path for fluid. The flow paths of the first set of plate assemblies extend in crossing relationship to the flow paths of the second set of plate assemblies. Because of the double wall design of the plate assemblies, any leakage will be vented before being able to corrode through to the other fluid. The plate assemblies have enlarged inlet and outlet openings for fluid to reduce pressure drop and pumping cost. One plate of each plate assembly has a first set of dimples to establish the space between plates and produce turbulence for good heat transfer, and a second set of dimples of reduced height to produce less pressure drop but still produce turbulence.

5 Claims, 10 Drawing Sheets

DOUBLE-WALL WELDED PLATE HEAT EXCHANGER

REFERENCE TO RELATED APPLICATION

This application is a continuation-in-part of copending application, Ser. No. 08/076,110, filed Jun. 14, 1993.

FIELD OF INVENTION

This invention relates generally to heat exchangers and refers more particularly to a compact, double-wall welded plate heat exchanger.

BACKGROUND AND SUMMARY

Welded plate heat exchangers are commonly made of flat, parallel plates sandwiched together and welded between cover panels. Two fluids, one relatively hot and the other relatively cold, are passed between alternate plates for heat transfer. Plate heat exchangers require less space than shell and tube heat exchangers, and transfer heat at a much higher rate.

The heat exchanger of this invention is made of two sets of plate assemblies. The plate assemblies of the first set are arranged with the plate assemblies of the second set in a stacked relationship, with the plate assemblies of the first and second sets respectively interleaved or alternated with one another. Each plate assembly has first and second plates which define a space for the flow of fluid. The plate assemblies are in heat transfer contact with one another and provision is made for venting between the plate assemblies to allow for possible leaks but without contamination of one fluid by the other. Preferably, at least one of the plates of each plate assembly have raised dimples to establish the spaced relationship between the plates and also to produce turbulence in the flow of fluid.

The plates of each plate assembly have end portions which cooperate to provide an inlet and an outlet for fluid. The end portions of at least one of these plates is offset to enlarge the inlet and outlet openings. The enlargement of the inlet and outlet openings substantially reduces pressure drop and pumping cost.

Preferably, all of the inlet openings for the plate assemblies of each set communicate with a manifold for the introduction of fluid and all of the outlet openings for the plate assemblies of each set communicate with a manifold for the withdrawal of fluid.

The heat exchanger of this invention is preferably of all welded construction, is compact, lightweight, low in cost, operates at low fluid volume, has a high pressure rating, high performance and high efficiency.

It is an object of this invention to provide a plate heat exchanger having some or all of the above features.

Another object is to provide a plate heat exchanger which is of relatively simple construction, rugged and durable in use, and easy to manufacture and assemble.

Another unique feature of this invention is using dimples of varying height to achieve less pressure drop, when required, while still maintaining turbulence for good heat transfer.

Other objects, features and advantages of the invention will become more apparent as the following description proceeds, especially when considered with the accompanying drawings.

DETAILED DESCRIPTION

Referring now particularly to the drawings, the heat exchanger 10 is shown as generally rectangular, although other shapes are possible.

Figure 1:
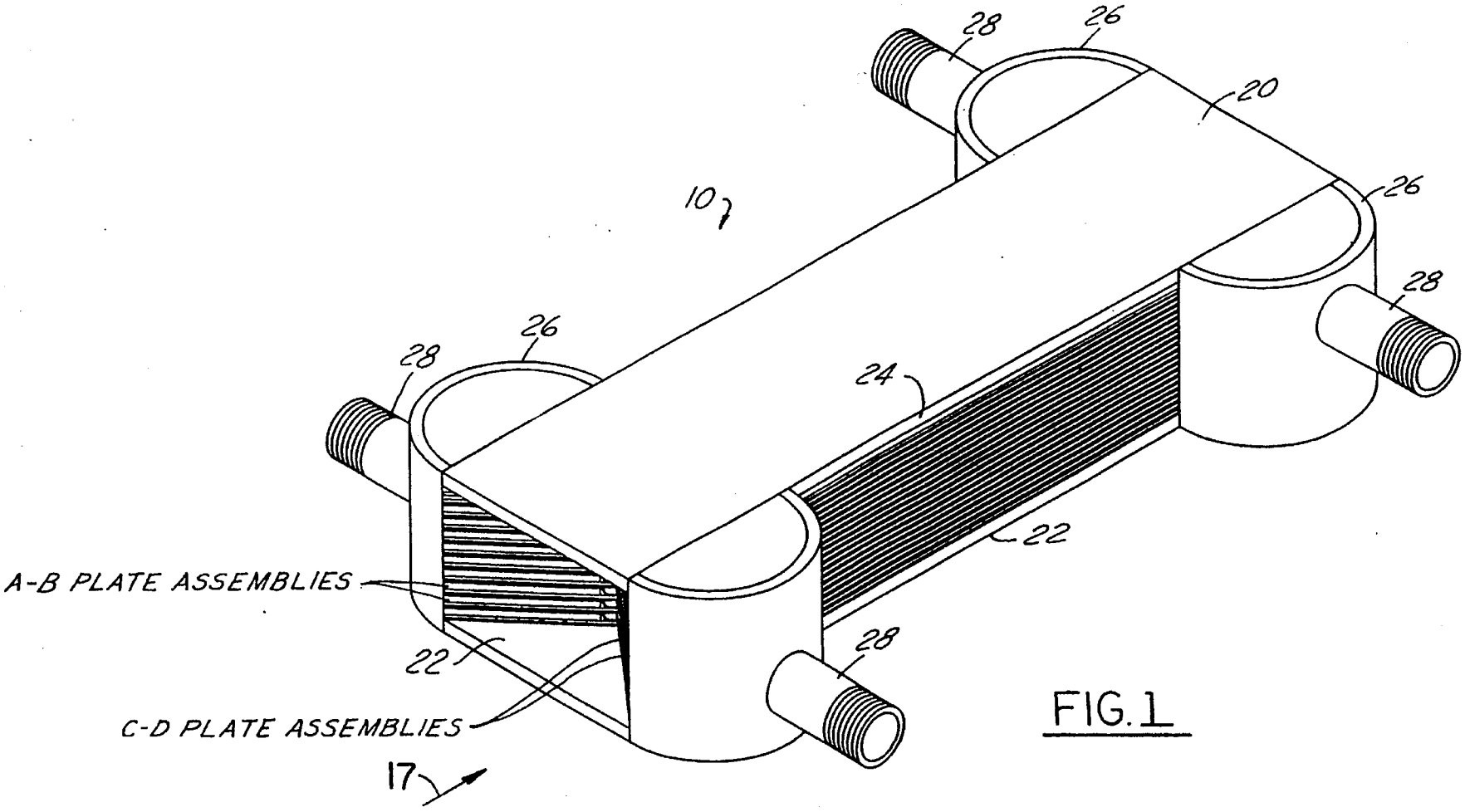
FIG. 1 is a perspective view of a plate heat exchanger embodying the invention.
Figure 2:
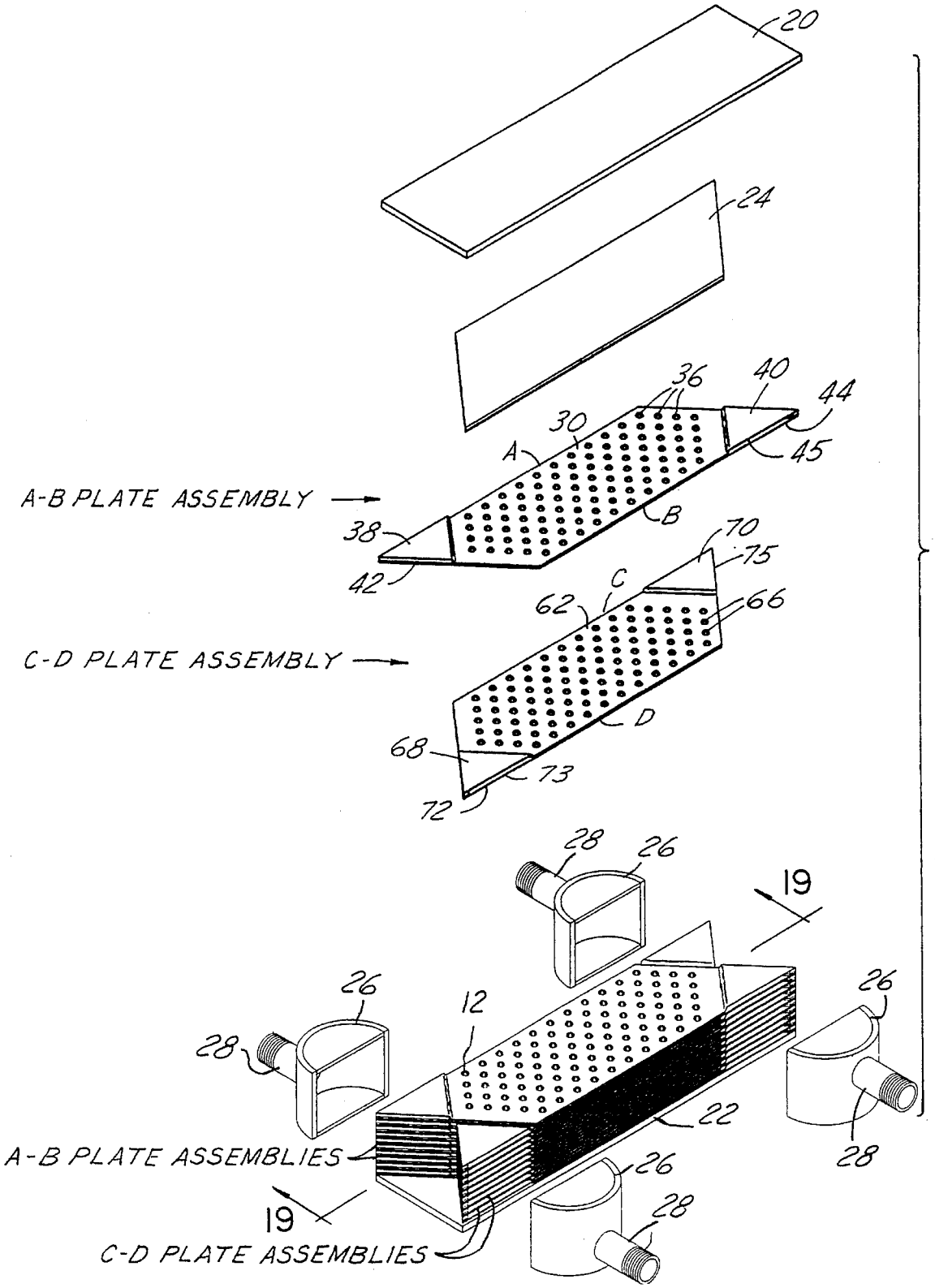
FIG. 2 is an exploded perspective view of the heat exchanger of FIG. 1.

FIG. 2 is an exploded view showing the various components or the heat exchanger, including a plurality of identical interior plate assemblies including plates A and B, hereinafter referred to as the A–B plate assemblies, a plurality of identical interior plate assemblies including plates C and D, hereinafter referred to as the C–D plate assemblies, a top cover panel 20, a bottom cover panel 22, a top spacer panel 24 and fluid manifolds 26 having tubular fittings 28.

The plates A and B of the A–B plate assemblies are in generally parallel, spaced apart relation defining a space 30 therebetween for fluid flow. The main body portions 32 and 34 of plates A and B each have a plurality of dimples 36. The dimples of the B plate contact the A plate to establish the spaced relationship and to create turbulence in fluid flow. The dimples of the A plate project in a direction away from the B plate. The dimples of the A and B plates are offset relative to one another so that they do not nest.

Figure 3:
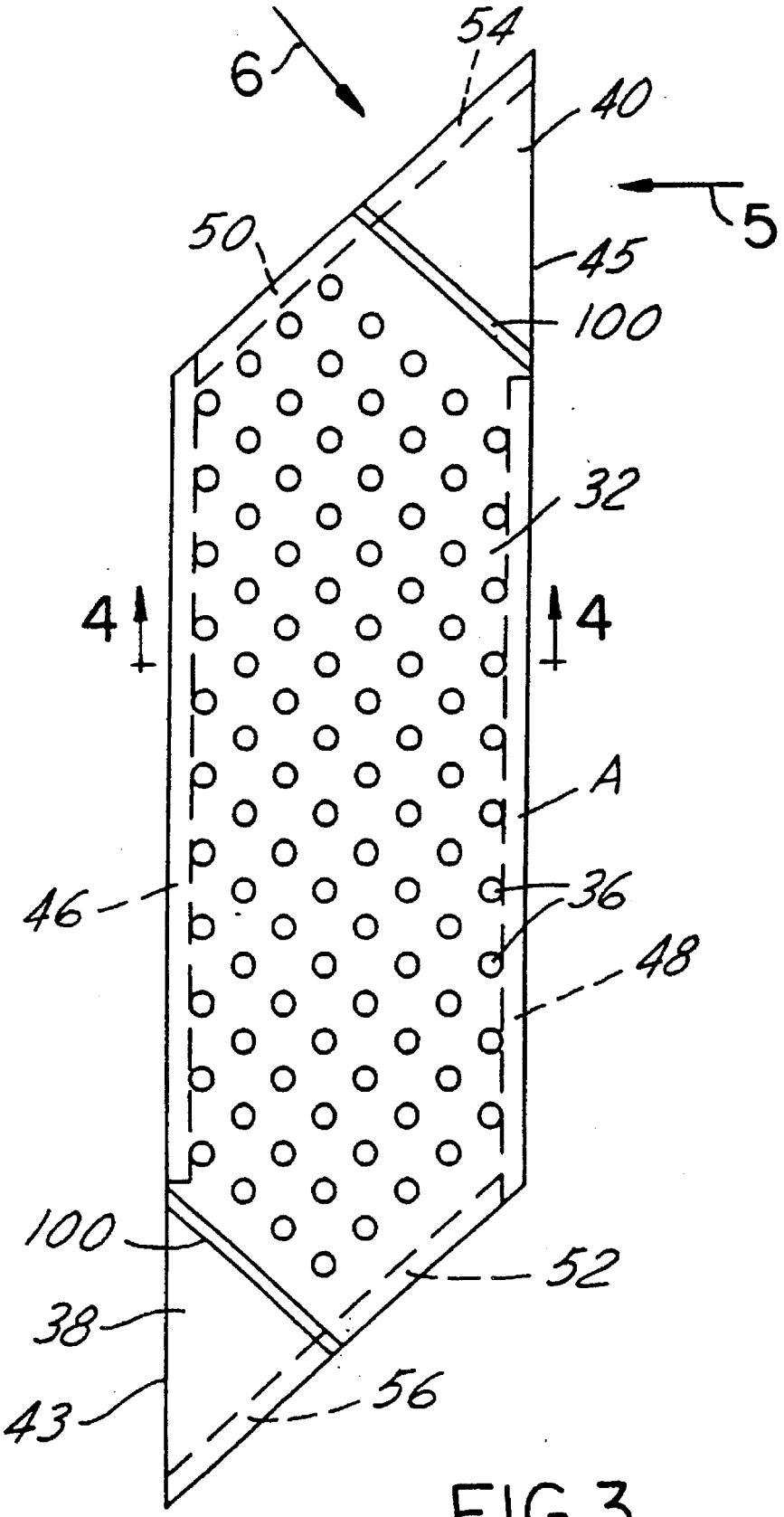
FIG. 3 is a plan view of one of the plates of one plate assembly.
Figure 4:
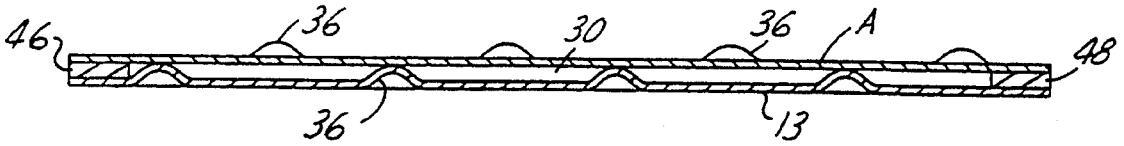
FIG. 4 is a sectional view taken on the line 4—4 in FIG. 3 showing the plate of FIG. 3 in association with another plate which completes the plate assembly.
Figure 5:
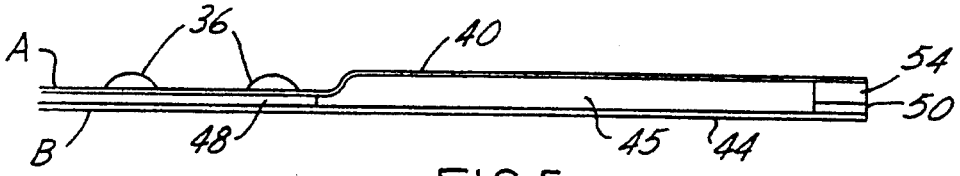
FIG. 5 is a fragmentary view looking in the direction of the arrow 5 in FIG. 3.
Figure 6:
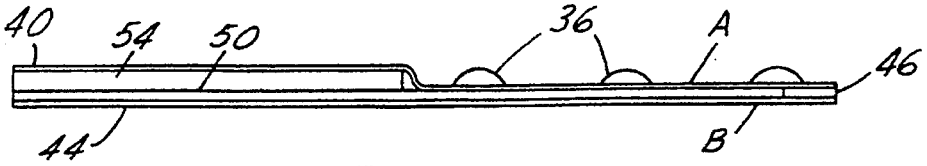
FIG. 6 is a fragmentary view looking in the direction of the arrow 6 in FIG. 3.

The plates A of the A–B plate assemblies have parallel sides and ends, with the ends cut at approximately 45° to the longitudinal centerline as shown in FIG. 3. The plates B of the A–B plate assemblies are of the same peripheral configuration as plates A. However, the tapered end portions 38 and 40 of each plate A where the sides and ends meet at an acute angle are bent up or away from the tapered end portions 42 and 44 of the corresponding plate B to provide an enlarged fluid inlet opening 43 and an enlarged fluid outlet opening 45. The enlarged fluid inlet and outlet openings increase fluid flow, and reduce pressure drop and pumping cost.

The plates A and B are disposed in substantially exact overlying relationship with their edges at each side superimposed one above the other and with their edges at each end superimposed one above the other.

A spacer strip 46 extends between the edges at one side of the A and B plates from one end of the plates to the inlet opening 43. A spacer strip 48 extends between the edges at the other side of the A and B plates from one end of the plates to the outlet opening 45.

A spacer strip 50 extends between the edges at one end of the A and B plates from one side to the other. A spacer strip 52 extends between the edges at the other end of the A and B plates from one side to the other. Additional spacer strips 54 and 56 attached respectively to spacer strips 50 and 52 fill the space at the tapered ends between the strips 50, 52 and the bent up end portions 38, 40. The spacer strips 50, 52, 54 and 56 are welded to the plates A and B to seal the space between the plates except for the inlet and outlet openings 43 and 45.

The plates C and D of the C–D plate assemblies are in generally parallel, spaced apart relation defining a space 60 therebetween for fluid flow. The main body portions 62 and 64 of plates C and D each have a plurality of dimples 66. The dimples of the C plate contact the D plate to establish the spaced relationship and to create turbulence in fluid flow. The dimples of the D plate project in a direction away from the C plate. The dimples of the C and D plates are offset relative to one another so that they do not nest.

Figure 9:
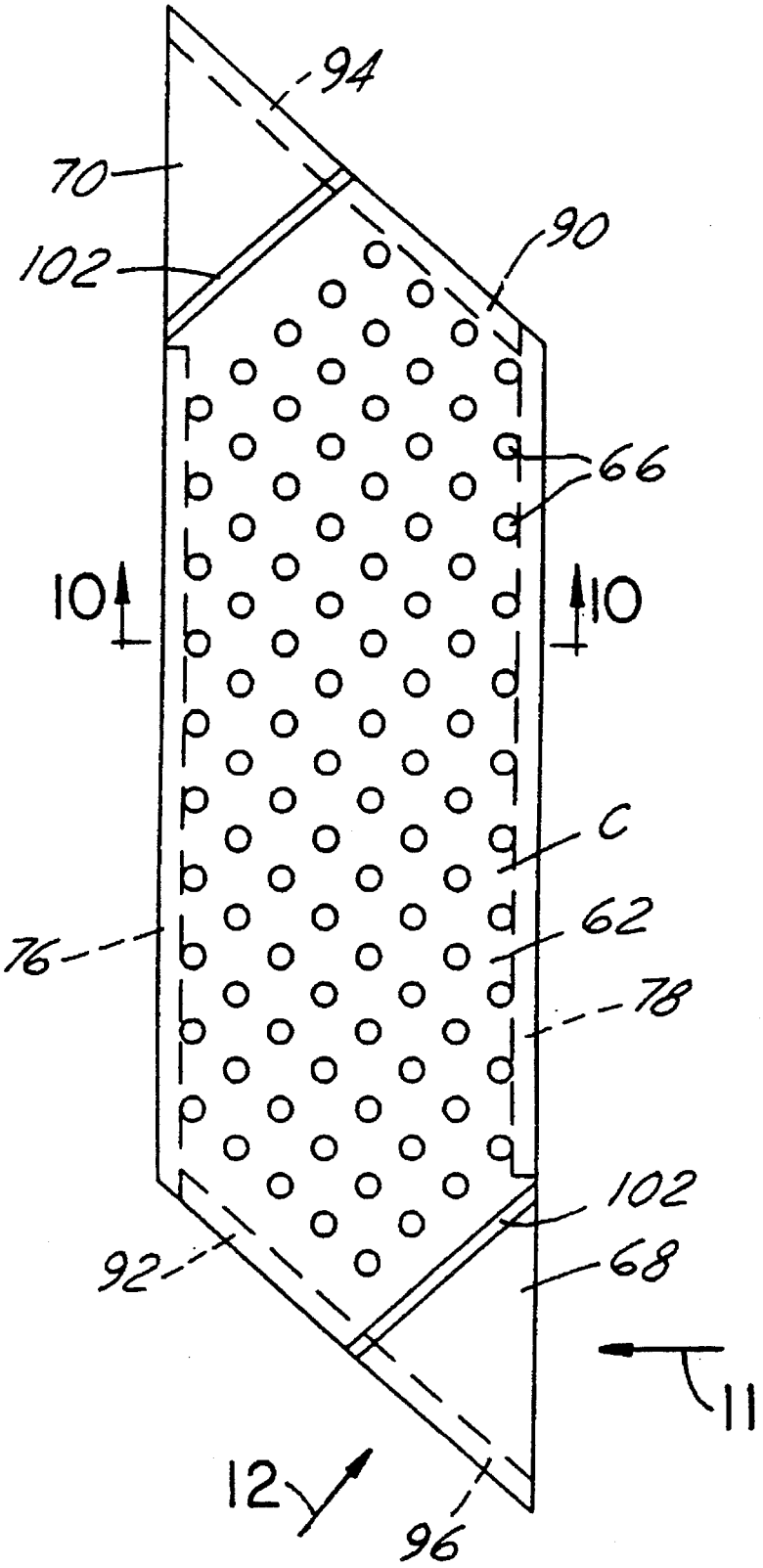
FIG. 9 is a plan view of a plate of the other plate assembly.
Figure 10:
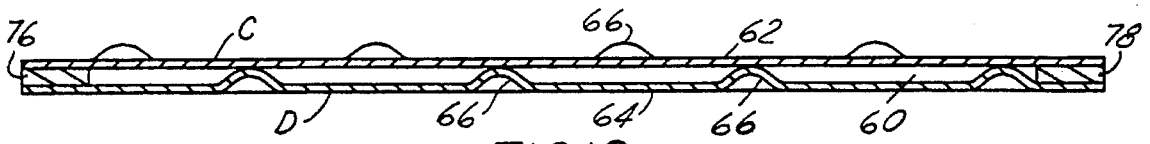
FIG. 10 is a sectional view taken on the line 10—10 in FIG. 9 showing the plate of FIG. 9 in association with another plate which completes the plate assembly.
Figure 11:
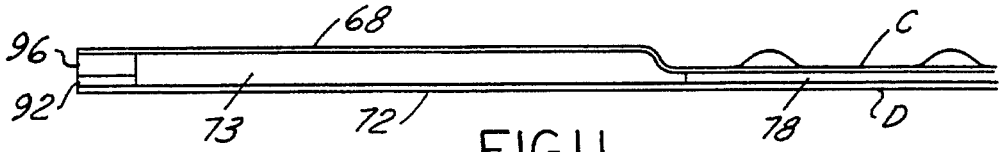
FIG. 11 is a view looking in the direction of the arrow 11 in FIG. 9.
Figure 12:
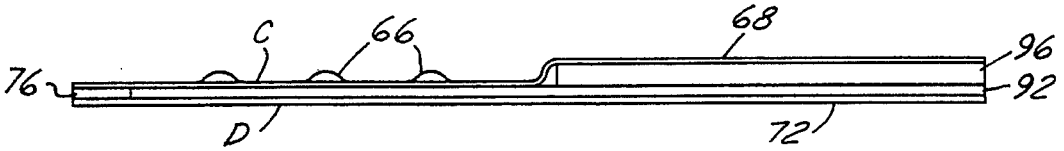
FIG. 12 is a view looking in the direction of the arrow 12 in FIG. 9.

The plates C of the C–D plate assemblies have parallel sides and ends, with the ends cut at approximately 45° to the longitudinal centerline as shown in FIG. 9. However, these ends are cut in the opposite direction from the ends of plates A and B of the A–B plate assemblies as will be appreciated from a comparison of FIGS. 3 and 9. The plates D of the C–D plate assemblies are of the same peripheral configuration as plates C. However, the tapered ends 68 and 70 of each plate C where the sides and ends meet at an acute angle are bent up or away from the tapered end portions 72 and 74 of the corresponding plate D to provide an enlarged fluid inlet opening 73 and an enlarged fluid outlet opening 75. The enlarged fluid inlet and outlet openings increase fluid flow, and reduce pressure drop and pumping cost.

The plates C and D are disposed in substantially exact overlying relationship with their edges at each side superimposed one above the other and with their edges at each end superimposed one above the other.

A spacer strip 78 extends between the edges at one side of the C and D plates from one end of the plates to the inlet opening 73. A spacer strip 76 extends between the edges at the other side of the C and D plates from one end of the plates to the outlet opening 75.

A spacer strip 90 extends between the edges at one end of the C and D plates from one side to the other. A spacer strip 92 extends between the edges at the other end of the C and D plates from one side to the other. Additional spacer strips 94 and 96 attached respectively to spacer strips 90 and 92 fill the space at the tapered ends between the strips 90, 92 and the bent up end portions 68, 70. The spacer strips 90, 92, 94 and 96 are welded to the plates C and D to seal the space between the plates except for the inlet and outlet openings 73 and 75.

The A–B plate assemblies are stacked alternately with the C–D plate assemblies, in other words, the plate assemblies are interleaved with one another so that a C–D plate assembly is placed upon an A–B plate assembly followed by another C–D plate assembly and so on. The side edges of all plate assemblies are directly superimposed.

The bottom plate D of a C–D plate assembly lies upon the top plate A of an A–B plate assembly with the main body portion of the D plate resting on the main body portion of the A plate with the dimples in contact, and with the end edges of the D plate fitting inside the lines 100 where the end portions of the A plate are bent. The bottom plate B of an A–B plate assembly lies upon the top plate C of a C–D plate assembly with the main body portion of the B plate resting on the main body portion of the C plate with the dimples in contact, and with the end edges of the B plate fitting inside the lines 102 where the end portions of the C plate are bent.

The top spacer panel 24 is a flat plate and has the same peripheral configuration as the C and D plates and is used when the A–B plate assembly is at the top of the stack, fitting on the A plate in the same manner as a D plate would fit. If a C–D plate assembly is at the top of the stack, then the same top spacer panel 24 may be used, but turned over or inverted.

The top and bottom cover panels 20 and 22 are flat rectangular plates which have the same width as the plate assemblies and the same length measured from the tip of one tapered end portion to the tip of the other.

As clearly seen in FIG. 2, the tapered end portions of the A–B plate assemblies are arranged in two separate tiers at diagonally opposite corners of the heat exchanger, so that all of the inlets of the A–B plate assemblies are in one tier and all of the outlets are in the other tier. Also, the tapered end portions of the C–D plate assemblies are arranged in two separate tiers at the other two diagonally opposite corners of the heat exchanger, so that all of the inlets of the C–D plate assemblies are arranged in one of the tiers and the outlets in the other.

Figure 17:
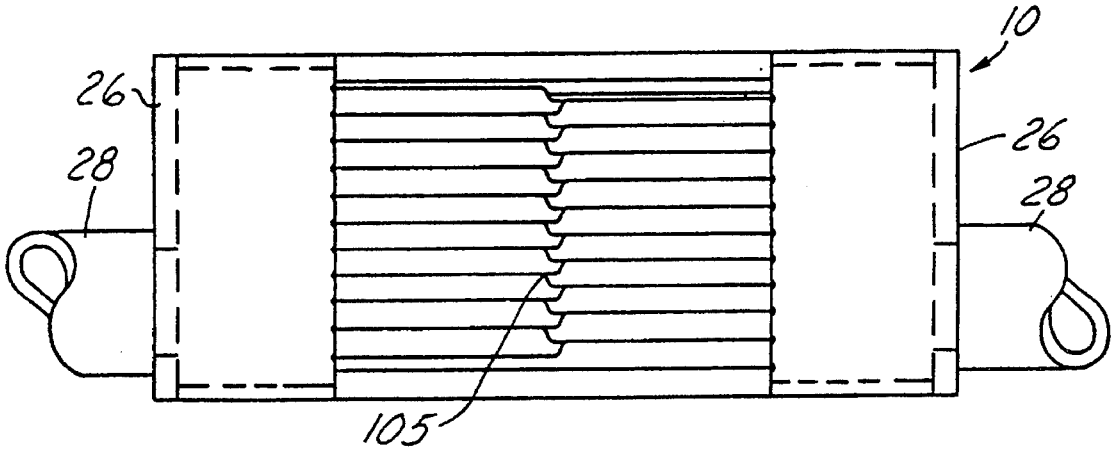
FIG. 17 is a view looking in the direction of the arrow 17 in FIG. 1 showing one end of the plate heat exchanger.
Figure 18:
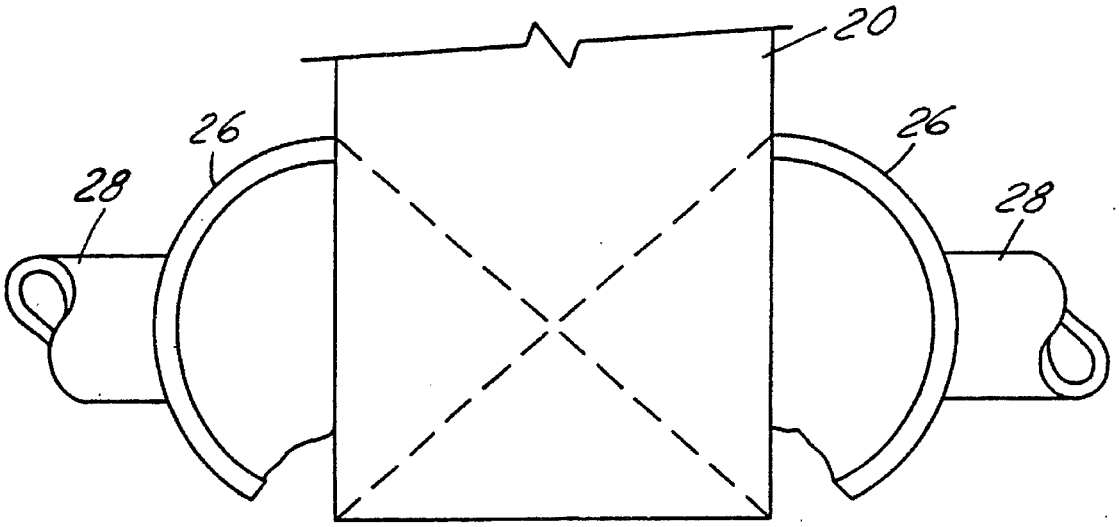
FIG. 18 is a fragmentary plan view of the end portion of the heat exchanger seen in FIG. 17.
Figure 19:
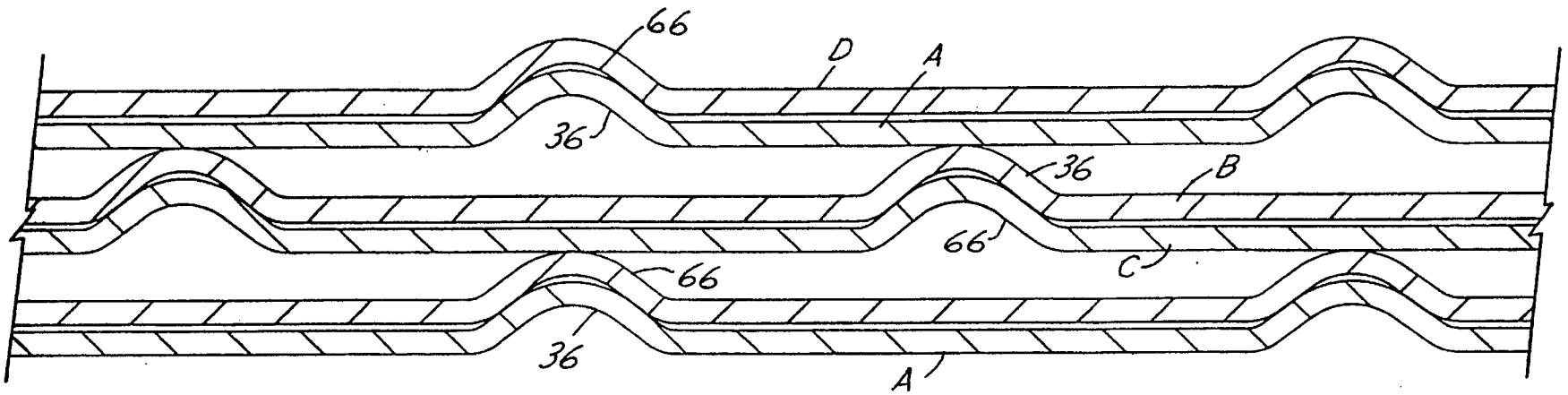
FIG. 19 is a sectional view taken on the line 19—19 in FIG. 2 showing the relationship of a plate of the plate assembly of one set with the confronting plate of the plate assembly in the other set.

When stacked in this manner, the side edges and ends of the plate assemblies and of the top and bottom cover panels 20 and 22 and the spacer panel 24 are suitably welded together around the entire periphery of the heat exchanger, except in the end areas between plate assemblies where indicated at 105 in FIG. 17 for venting of any leaked fluid as described hereinafter. The bent-up end portions 38 and 40 of the A plates are welded to the B plates, and the bent-up end portions 68 and 70 of the C plates are welded to the D plates. There is very little if any space between the confronting plates of the stacked plate assemblies since the dimples of the confronting A and D plates and of the confronting B and C plates nest with one another as shown in FIG. 19. This minimal spacing between sealed plate assemblies provides venting for possible leaks, but prevents contamination of one fluid by the other.

The inlet and outlet openings of the A–B plate assemblies define parallel, diagonal flow paths for a first fluid in the spaces between the A and B plates thereof. The inlet and outlet openings of the C–D plate assemblies define parallel diagonal flow paths for a second fluid in the spaces between the C and D plates thereof which cross the flow paths of the fluid between the A and B plates. One fluid may be relatively hot and the other relatively cold.

There are four manifolds 26 for the two inlet and two outlet openings. Each manifold is in the form of a cap welded and sealed to the heat exchanger to deliver fluid to all of the inlets in the same tier or withdraw fluid from all of the outlets in the same tier. A tubular member or pipe 28 communicates with each manifold.

Figure 7:
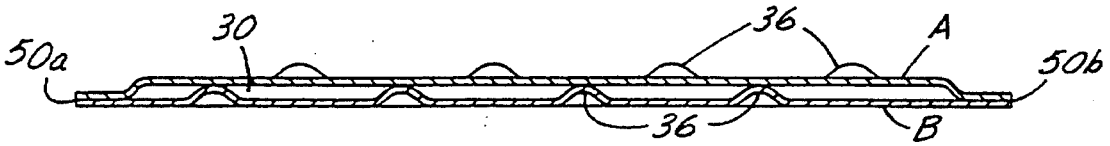
FIG. 7 is a sectional view similar to FIG. 4 but showing a modification.
Figure 8:
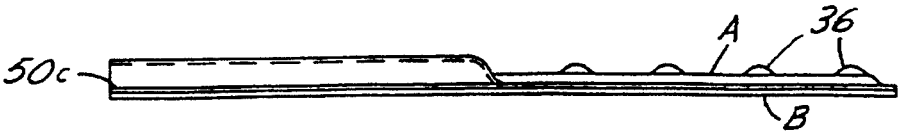
FIG. 8 is similar to FIG. 6 and relates to the same modification as FIG. 7.

FIGS. 7 and 8 show a modification in which the spacer strips are eliminated from the A–B plate assembly. In this modification, the side and end edges of one of the plates are bent up to meet the side and end edges of the other plate and welded thereto, as indicated at 50*a*, 50*b* and 50*c*.

Figure 13:
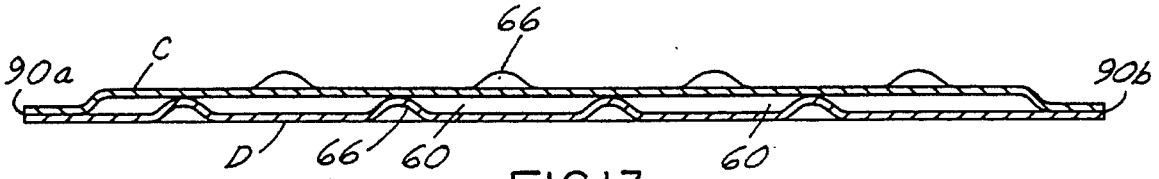
FIG. 13 is a sectional view similar to FIG. 10 but showing a modification.
Figure 14:
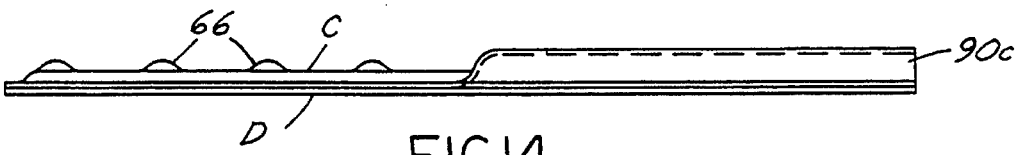
FIG. 14 is similar to FIG. 12 and relates to the same modification as FIG. 13.
Figure 15:
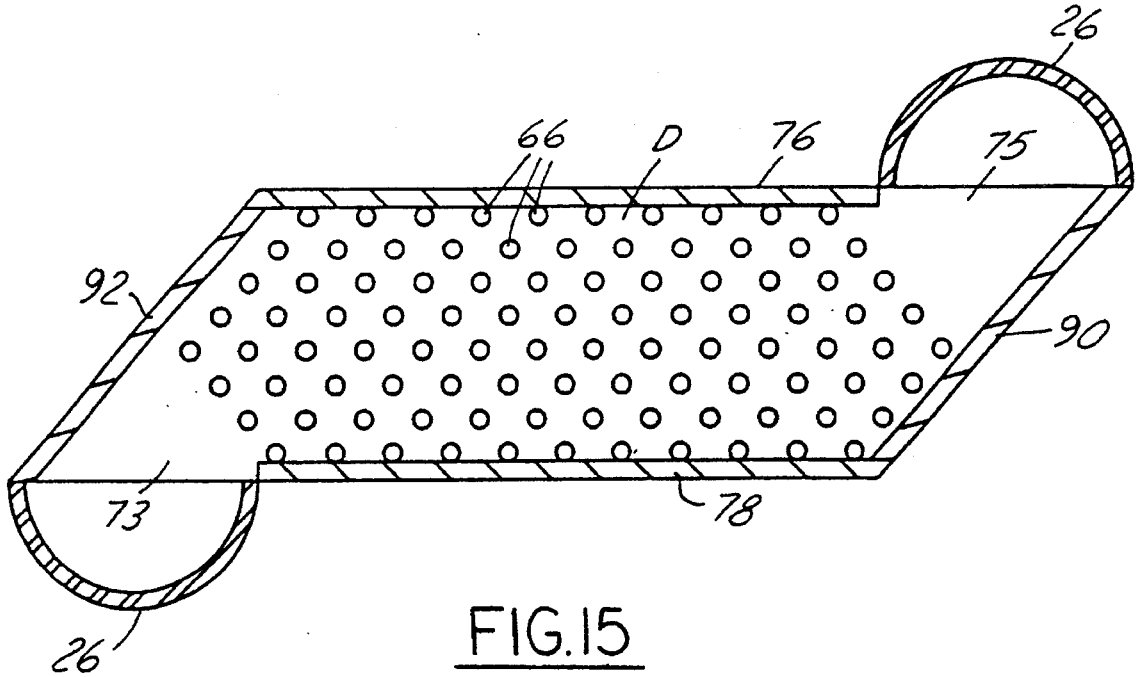
FIG. 15 is a horizontal section through the heat exchanger as seen in FIG. 1 in a plane through a plate assembly of one of the sets of plate assemblies.
Figure 16:
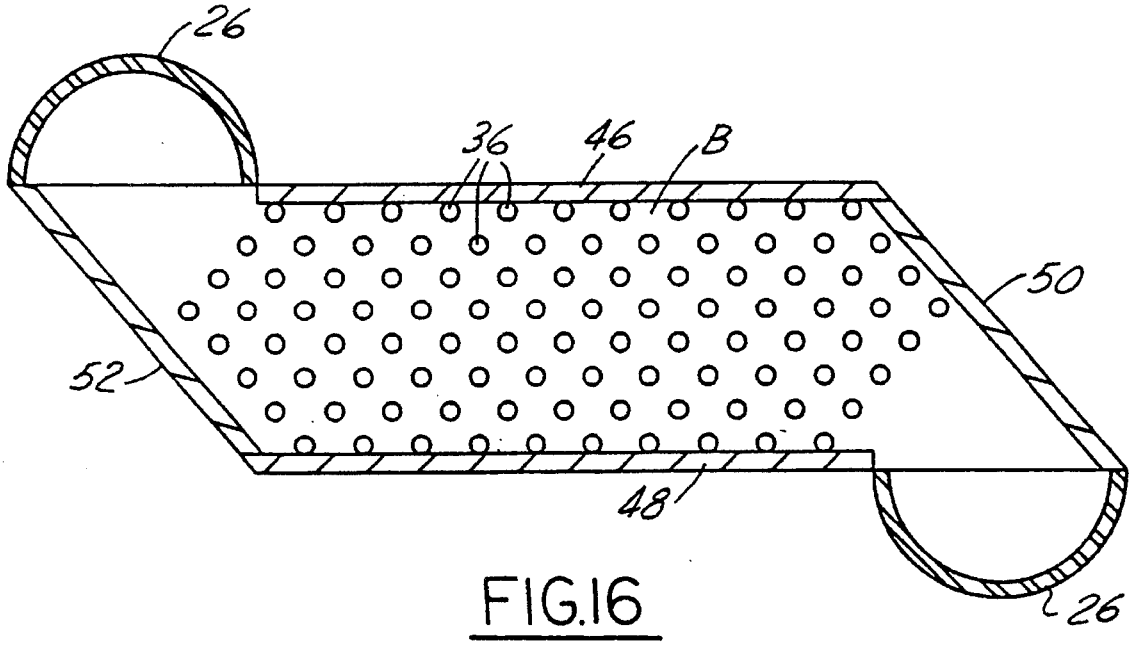
FIG. 16 is a horizontal section through the heat exchanger as seen in FIG. 1 in a plane through a plate assembly of the other set of plate assemblies.

FIGS. 13 and 14 show a similar modification of the C–D plate assembly in which the spacer strips are eliminated. The side and end edges of one of the plates are bent up to meet the side and end edges of the other plate and welded thereto as indicated at 90*a*, 90*b* and 90*c*.

The widening of the inlet and outlet openings improves fluid flow, and reduces pressure drop and pumping cost. The tapered ends further enlarge these openings, in contrast to square cut ends. Also, the diagonal or crossing counter-current flow paths of the two fluids maximizes heat transfer and contact area with the plate assemblies. In addition, the double wall design incorporating A–B plate assemblies for one fluid alternated with C–D plate assemblies for another fluid insures that if a leak of one fluid occurs, it will be vented before being able to corrode through to the other fluid.

Figure 20:
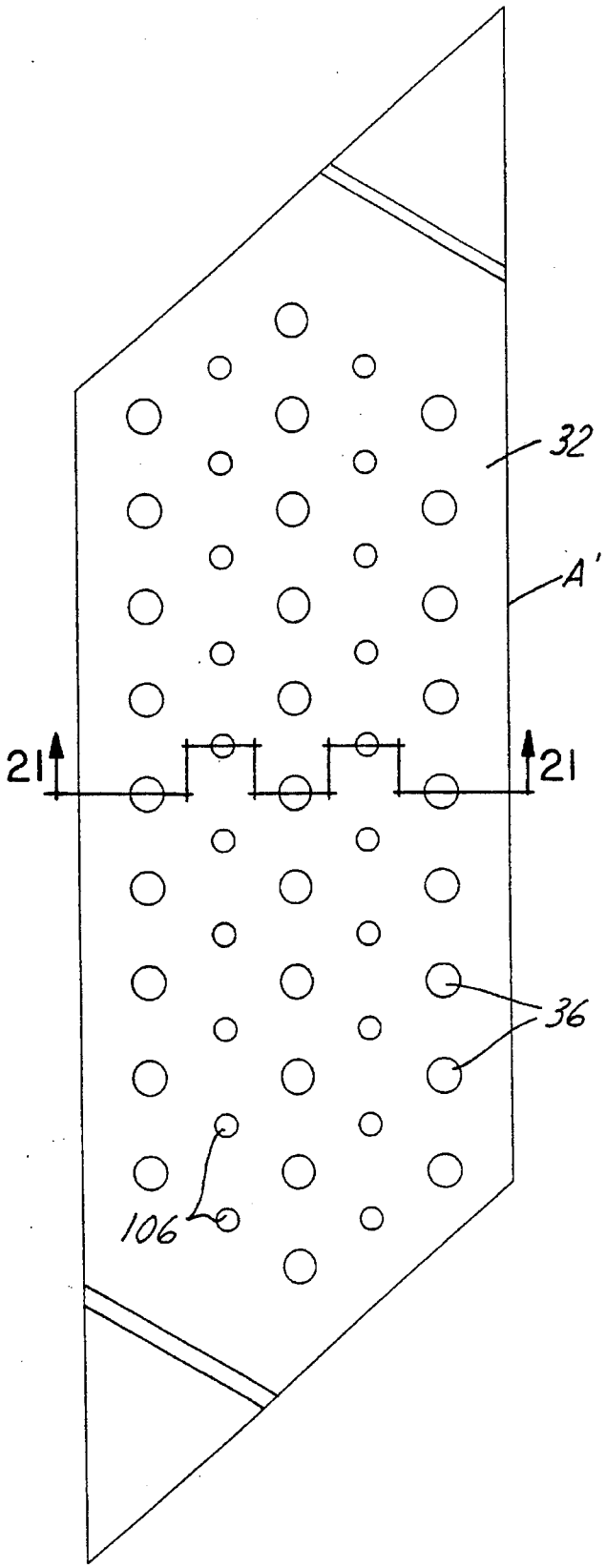
FIG. 20 is a plan view of a plate similar to FIG. 3 showing different size dimples for reduction of pressure drop, while maintaining turbulence for good heat transfer.
Figure 21:
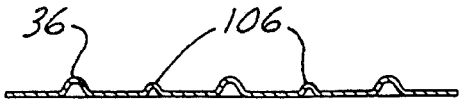
FIG. 21 is a sectional view taken on the line 21—21 in FIG. 20.

Another unique feature of this invention is illustrated in FIGS. 20 and 21. These figures show a modified plate A' which is like the A plate except that some of the dimples 36 have been replaced by dimples 106 which are of a lesser height (or depth) than dimples 36. The B plates are likewise similarly modified to have the same pattern of dimples 36 and 106 as the A' plates, offset from the dimples of the A' plate to prevent nesting. In an A'–B' plate assembly, the dimples 36 will establish plate spacing, but the use of some dimples of lesser height which do not contact the other plate will reduce pressure drop and yet maintain turbulence from good heat transfer.

The C and D plates of the C–D plate assemblies may be modified in the same way as shown in FIGS. 20 and 21.

I claim:

1. A plate heat exchanger comprising:

a first set of plate assemblies, a second set of plate assemblies, the plate assemblies of the first set being arranged alternately with the plate assemblies of the second set in a stacked, parallel relationship such that the plate assemblies of the first and second sets are respectively interleaved with one another, each plate assembly of said first set comprising a first elongated plate having a longitudinal center line and a second elongated plate having a longitudinal center line, said first and second plates of each plate assembly of said first set being arranged with their center lines generally parallel and having parallel, generally planar main body portions defining a space therebetween for the flow of a first fluid, each plate assembly of said second set comprising a third elongated plate having a longitudinal center line and a fourth elongated plate having a longitudinal center line, said third and fourth plates of each plate assembly of said second set being arranged with their center lines generally parallel and having parallel, generally planar main body portions defining a space therebetween for the flow of a second fluid, the plates of the plate assemblies of said first set each having first and second end edges which are parallel to one another and disposed at an approximate 45° angle to the longitudinal center line thereof, the plates of the plate assemblies of said second set each having third and fourth end edges which are parallel to one another and disposed at an approximate 45° angle to the longitudinal center line thereof in crossing relation to said first and second end edges respectively of the plates of the plate assemblies of said first set, said first and second plates of the plate assemblies of said first set having tapered end portions which extend beyond the main body portions thereof and beyond the third and fourth end edges respectively of the plates of said second set of plate assemblies, said third and fourth plates of the plate assemblies of said second set having tapered end portions which extend beyond the main body portions thereof and beyond the first and second end edges respectively of the plates of said first set of plate assemblies, said tapered end portions at one end of said first and second plates of each of the plate assemblies of said first set overlying one another in a registering pair and defining a fluid inlet opening and at the opposite end thereof overlying one another in a registering pair and defining a fluid outlet opening, and said tapered end portions at one end of said third and fourth plates of each of the plate assemblies of said second set overlying one another in a registering pair and defining a fluid inlet opening and at the opposite end thereof overlying one another in a registering pair and defining a fluid outlet opening.

2. A plate heat exchanger as defined in claim 1, wherein the main body portion of the first plate of each plate assembly of the first set has a plurality of spaced-apart raised dimples projecting away from the main body portion of the second plate thereof, the main body portion of the second plate of each plate assembly of the first set has a plurality of spaced-apart raised dimples projecting toward the main body portion of the first plate thereof but in offset relation thereto to establish the aforesaid space therebetween for the flow of the first fluid, the dimples of the first and fourth plates of the interleaved plate assemblies nesting with one another so that the first and fourth plates are in heat transfer contact and provide venting for possible leaks, the main body portion of the third plate of each plate assembly of the second set has a plurality of spaced-apart raised dimples projecting away from the main body portion of the fourth plate thereof, the main body portion of the fourth plate of each plate assembly of the second set has a plurality of spaced-apart raised dimples projecting toward the main body portion of the third plate thereof but in offset relation thereto to establish the aforesaid space therebetween for the flow of the second fluid, the dimples of the second and third plates of the interleaved plate assemblies nesting with one another so that the second and third plates are in heat transfer contact and provide venting for possible leaks.

3. A plate heat exchanger as defined in claim 1, wherein said heat exchanger is generally rectangular having diagonally opposite first and second corners and diagonally opposite third and fourth corners, the inlet and outlet openings of said first set of plate assemblies are arranged respectively in first and second tiers at the first and second corners, the inlet and outlet openings of said second set of plate assemblies are arranged respectively in third and fourth tiers at the third and fourth corners, the inlet and outlet openings in the first and second tiers defining generally parallel, diagonal first flow paths for the first fluid in the first set of plate assemblies, and the inlet and outlet openings in the third and fourth tiers defining generally parallel, diagonal second flow paths for the second fluid in the second set of plate assemblies.

4. A plate heat exchanger as defined in claim 3, and further including a manifold fitting for the inlet and outlet openings associated with each of said respective tiers.

5. A plate heat exchanger comprising:

a first set of plate assemblies, a second set of plate assemblies, the plate assemblies of the first set being arranged alternately with the plate assemblies of the second set in a stacked, parallel relationship such that the plate assemblies of the first and second sets are respectively interleaved with one another, each plate assembly of said first set comprising a first plate and a second plate, said first and second plates of each plate assembly of said first set having parallel, generally planar main body portions defining a space therebetween for the flow of a first fluid, each plate assembly of said second set comprising a third plate and a fourth plate, said third and fourth plates of each plate assembly of said second set having parallel, generally planar main body portions defining a space therebetween for the flow of a second fluid, the main body portion of the first plate of each plate assembly of the first set having a plurality of spaced-apart raised dimples projecting away from the main body portion of the second plate thereof, the main body portion of the second plate of each plate assembly of the first set having a plurality of spaced-apart raised dimples projecting toward the main body portion of the first plate thereof but in offset relation thereto to establish the aforesaid space therebetween for the flow of the first fluid, the dimples of the first and fourth plates of the interleaved plate assemblies nesting with one another to define minimum spacing therebetween and provide venting for possible leaks, the main body portion of the third plate of each plate assembly of the second set having a plurality of spaced-apart raised dimples projecting away from the main body portion of the fourth plate thereof, the main body portion of the fourth plate of each plate assembly of the second set having a plurality of spaced-apart raised dimples projecting toward the main body portion of the third plate thereof but in offset relation thereto to establish the aforesaid space therebetween for the flow of the second fluid, the dimples of the second and third plates of the interleaved plate assemblies nesting with one another to define minimum spacing therebetween and provide venting for possible leaks.

* * * * *